US009105206B2

(12) United States Patent
Miletich et al.

(10) Patent No.: US 9,105,206 B2
(45) Date of Patent: Aug. 11, 2015

(54) LED-ILLUMINATED SIGN

(75) Inventors: Don Miletich, Franklin, WI (US); John Stanley, Racine, WI (US)

(73) Assignee: Cree, Inc., Durham, NC (US)

( * ) Notice: Subject to any disclaimer, the term of this patent is extended or adjusted under 35 U.S.C. 154(b) by 344 days.

(21) Appl. No.: 12/977,282

(22) Filed: Dec. 23, 2010

(65) Prior Publication Data

US 2012/0159821 A1 Jun. 28, 2012

(51) Int. Cl.
*G09F 13/04* (2006.01)

(52) U.S. Cl.
CPC ..... *G09F 13/0409* (2013.01); *G09F 13/0413* (2013.01)

(58) Field of Classification Search
CPC ..... G09F 13/04; G09F 13/14
USPC ..... 40/564, 572, 570; 362/96, 11, 249.2, 362/800, 235, 311.01, 311.2, 311.14
See application file for complete search history.

(56) References Cited

U.S. PATENT DOCUMENTS

| | | | | |
|---|---|---|---|---|
| 1,604,622 | A | 10/1926 | Weinstein | |
| 1,719,918 | A | 7/1929 | Wetzel | |
| 2,849,817 | A | 9/1958 | Krayer | |
| 3,562,942 | A * | 2/1971 | Mabrey | 40/570 |
| 4,136,474 | A * | 1/1979 | Belokin, Jr. | 40/559 |
| 4,587,755 | A * | 5/1986 | Sunshine | 40/571 |
| 5,566,483 | A | 10/1996 | Ogren | |
| 5,665,938 | A * | 9/1997 | Boshear et al. | 174/50 |
| 5,890,794 | A * | 4/1999 | Abtahi et al. | 362/294 |
| 6,167,648 | B1 | 1/2001 | Dimmick | |
| 6,427,369 | B1 | 8/2002 | Durinzi, Jr. et al. | |
| 7,025,477 | B2 * | 4/2006 | Blessing et al. | 362/364 |
| 7,708,424 | B2 * | 5/2010 | Richmond | 362/183 |
| 2005/0039361 | A1 * | 2/2005 | Wu et al. | 40/572 |
| 2006/0181872 | A1 * | 8/2006 | Pashley | 362/231 |

* cited by examiner

*Primary Examiner* — Syed A Islam
(74) *Attorney, Agent, or Firm* — Jansson Munger McKinley and Shape Ltd.

(57) ABSTRACT

The inventive LED-illuminated sign structure includes a frame, an outer shell and a plurality of separate LED emitters. The frame includes two opposite main support panels each having an upright outward surface, and shell-supporting members. The outer shell has a pair of opposite translucent sidewalls each extending along and is spaced from the respective outward surface. The LED emitters are spaced on each outward surface such that the translucent sidewalls are illuminated substantially entirely. The frame defines an open region for passing reflected light within the frame structure to and through the opposite translucent sidewall. The LED illuminator includes an LED emitter on a mounting surface, a one-piece lens member over the LED emitter and including a lens portion and a flange portion, and a gasket between the flange portion and the mounting surface. The lens member has a restraining ridge positioned to press the LED-emitter wires and the gasket against the mounting surface such that the wire portions between the ridge and the LED emitter remain in substantially fixed position regardless of wire movement beyond the restraining ridge.

18 Claims, 6 Drawing Sheets

LED-ILLUMINATED SIGN

FIELD OF THE INVENTION

This invention relates to light fixtures. More particularly, this invention relates to such light fixtures which utilize LEDs as light source for internal illumination of signs and the like.

BACKGROUND OF THE INVENTION

In recent years, the use of light-emitting diodes (LEDs) for various common lighting purposes has increased, and this trend has accelerated as advances have been made in LEDs and in LED-array bearing devices, often referred to as "LED modules." Indeed, lighting applications which have been served by fixtures using high-intensity discharge (HID) lamps, fluorescent lamps and other light sources are now increasingly beginning to be served by LEDs. Such lighting applications include, among a good many others, roadway lighting, parking lot lighting, sign illumination and many other applications. Creative work continues in the field of using LEDs for light fixtures in various applications. It is the latter field to which this invention relates.

High-luminance light fixtures using LEDs as light source for outdoor applications present particularly challenging problems. High costs due to high complexity becomes a particularly difficult problem when high luminance, reliability, and durability are essential to product success. Keeping electronic LED drivers in a water/air-tight location may also be problematic, particularly when the light fixtures are constantly exposed to the elements and many LEDs are used.

Dealing with heat dissipation requirements is still another problem area for high-luminance LED light fixtures. Heat dissipation is difficult in part because high-luminance LED light fixtures typically have many LEDs. Complex structures for module mounting and heat dissipation have sometimes been deemed necessary, and all of this adds to complexity and cost.

In short, there is a significant need in the lighting industry for improved light fixtures and the like using LEDs. There is a need for fixtures that are adaptable for a wide variety of lighting situations, and that satisfy the problems associated with heat dissipation and appropriate protection of electronic LED driver components. Finally, there is a need for an improved LED-module-based sign illumination light fixture which is simple, and is easy and inexpensive to manufacture.

OBJECTS OF THE INVENTION

It is an object of the invention to provide an improved LED-illuminated sign that overcomes some of the problems and shortcomings of the prior art, including those referred to above.

Another object of the invention is to provide an improved outdoor LED-illuminated sign with excellent protection of the electronic LED drivers needed for such products.

Still another object of the invention is to provide an improved LED-illuminated sign with both good protection of electronic LED drivers and excellent heat dissipation.

Yet another object of the invention is to provide and improved LED-illuminated sign providing desirable illumination.

How these and other objects are accomplished will become apparent from the following descriptions and the drawings.

SUMMARY OF THE INVENTION

The present invention is an improvement in illuminated sign structures. The inventive LED-illuminated sign structure includes a frame, an outer shell and a plurality of separate LED emitters. The frame may be for securement atop a service-station fuel-pump unit and may be secured with respect to the upper portion of the pump unit. The frame preferably includes two opposite main support panels each of which has a substantially upright outward surface and shell-supporting members. The outer shell is preferably secured to the shell-supporting members of the frame and has a pair of opposite translucent sidewalls with inner and outer surfaces. The shell and the shell-supporting members are preferably configured and arranged such that each translucent sidewall extends along and is spaced from the outward surface of a respective one of the main support panels. The outer shell preferably includes a topwall spanning between the sidewalls. The plurality of separate LED emitters are secured on each outward surface at spaced positions thereon. It is preferred that the spaced position and the spacing of each of the translucent sidewalls from the corresponding support-panel outward surface be such that the translucent sidewalls are illuminated substantially entirely. Each support panel is preferably a heat sink providing heat dissipation away from the LED emitters.

Each support panel is preferably configured such that the frame defines an open region which permits some of the light from the LED emitters on such support panel, when reflected from the inner surface of the adjacent translucent sidewall, to pass within the frame structure to and through the opposite translucent sidewall.

The LED-illuminated sign structure further preferably includes an LED driver supported by the frame between the main support panels.

In preferred embodiments, each LED emitter includes an LED module and a lens thereover configured to spread the light from the LED module, thereby to facilitate substantially uniform illumination of the shell.

Each LED emitter preferably includes an LED module removably secured to one of the support panels; a one-piece lens member over the LED module, the lens member including a lens portion and a surrounding flange portion which is removably secured to such support panel; and a weatherproof seal between the flange portion and the support panel, whereby each LED emitter is individually replaceable and serviceable. The LED module is preferably a multi-chip module. The weatherproof seal is preferably a gasket configured to allow passage of wires to the module for electrical connection.

The frame has an inward surface. The LED-emitter wires extend along the inward surface; and an LED driver is secured with respect to the inward surface.

The outer shell includes graphics thereon which are illuminated by the LED emitters.

The outer shell and the frame may be substantially rectangular. Such frame has a second pair of opposite support panels each of which is connected to both of the main support panels and has an outward surface. The outer shell preferably has four translucent sidewalls each of which extends along and is spaced from the outward surface of a respective one of the support panels. Additional LED emitters are preferably secured on each of the support panels of the second pair, whereby the sign structure has 360° internal illumination.

The LED illuminator preferably includes an LED emitter on a mounting surface; a one-piece lens member secured to the mounting surface over the LED emitter, the lens member having a mounted side and a free side and including (a) a lens portion and (b) a flange portion outwardly extending from the lens portion; and a gasket between the flange portion and the mounting surface. The gasket preferably defines a wire passage allowing the LED-emitter wires to pass therethrough for electrical connection to the LED emitter. The lens member preferably has a restraining ridge extending from the mounted side thereof and positioned to press the wires and the gasket against the mounting surface such that the wire portions between the ridge and the LED emitter remain in substantially fixed position regardless of wire movement beyond the restraining ridge.

The mounting surface is preferably a heat sink for dissipating heat from the LED emitter. The LED illuminator is preferably a member of an array of LED illuminators secured to the mounting surface, each LED illuminator of the array being separately removably secured to the mounting surface such that each LED illuminator is individually replaceable and serviceable.

The mounting surface may be secured inside an outer shell. It is preferred that the shell includes a translucent wall which has inner and outer surfaces, the inner surface of the translucent wall being spaced from the mounting surface such that the translucent wall is illuminated substantially entirely.

DETAILED DESCRIPTION OF PREFERRED EMBODIMENTS

Figure 1:
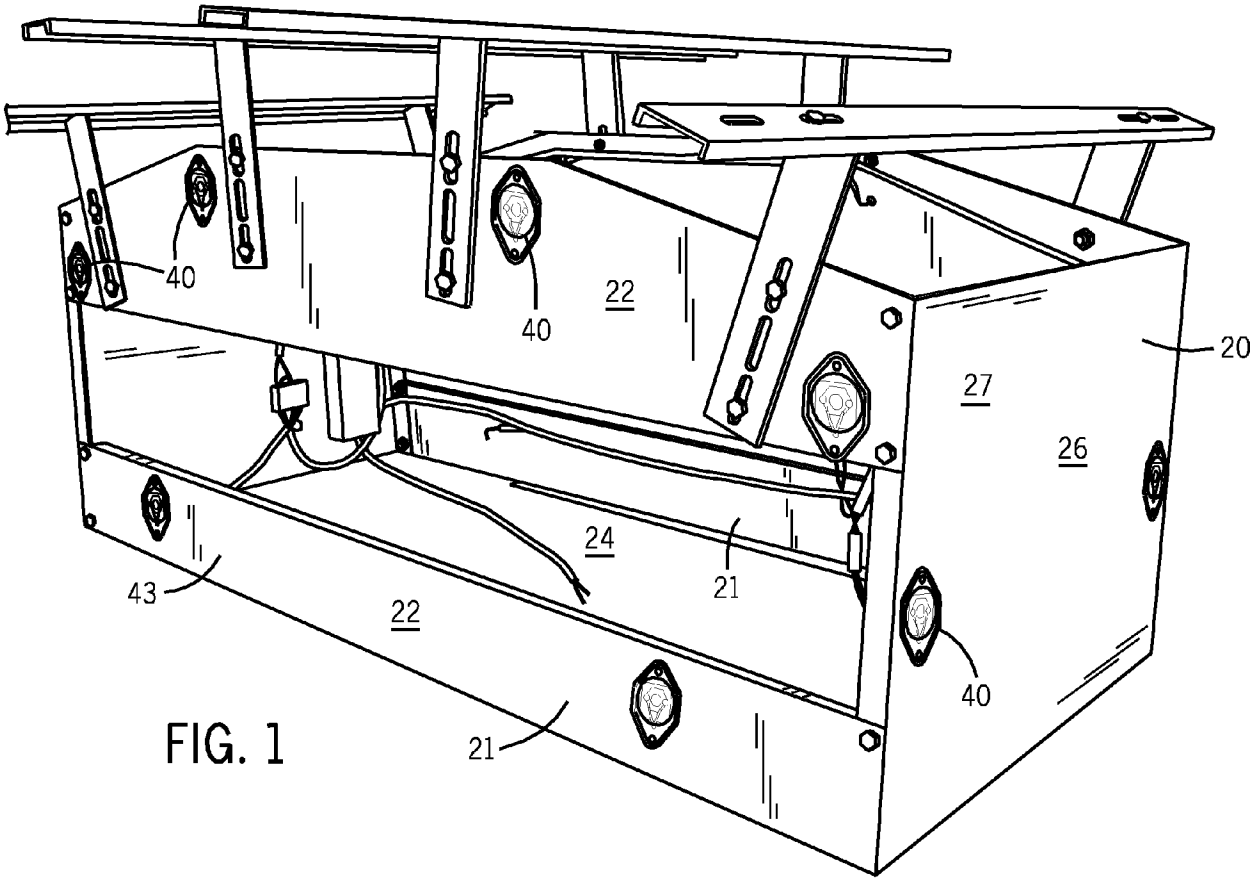
FIG. 1 is a perspective view of a frame with a plurality of separate LED emitters thereon.
Figure 2:
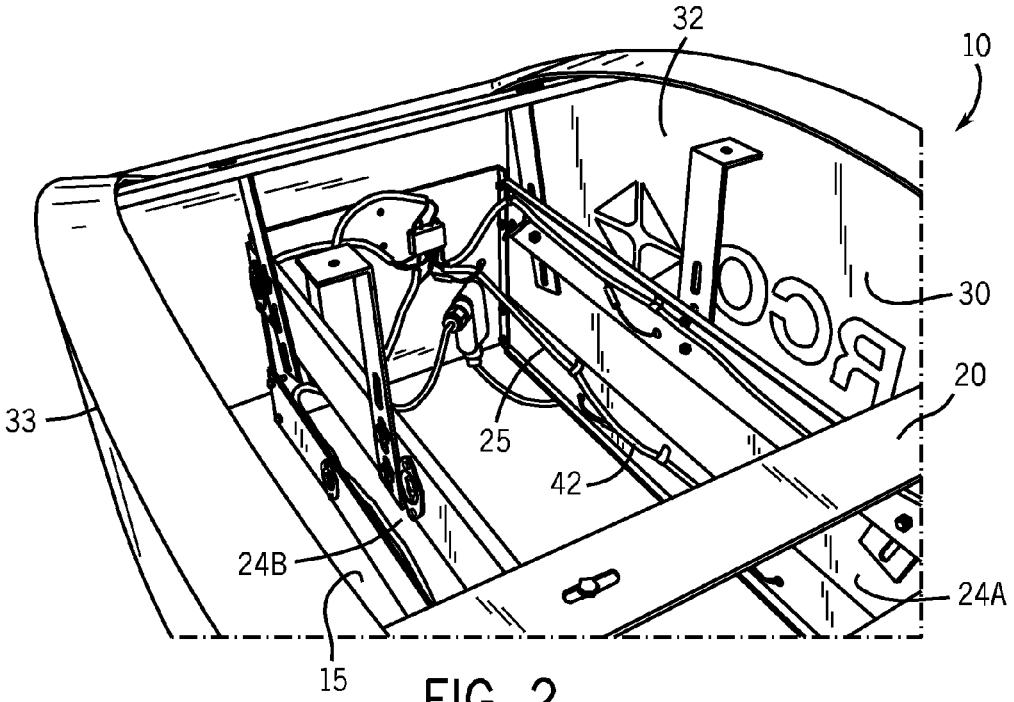
FIG. 2 is a fragmentary perspective view from above showing an interior of the LED-illuminated sign according to the present invention.
Figure 3:
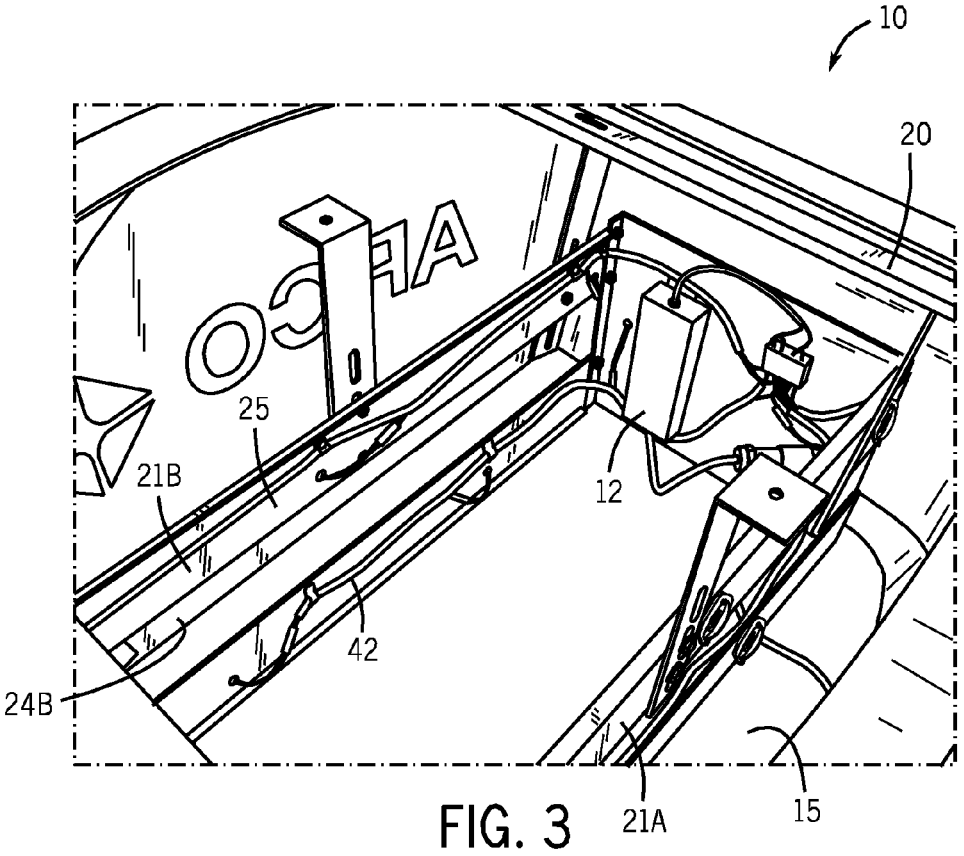
FIG. 3 is another fragmentary perspective view from above showing the interior of the LED-illuminated sign.

FIGS. 1-10 illustrate a preferred LED-illuminated sign 10. As best seen in FIGS. 1-5, inventive LED-illuminated sign structure 10 includes a frame 20, an outer shell 30 and a plurality of separate LED emitters 40. Frame 20 may be for securement atop a service-station fuel-pump unit (not shown) and may be secured with respect to the upper portion of the pump unit. FIGS. 1-3 best show that frame 20 includes two opposite main support panels 21 each of which has a substantially upright outward surface 22 and shell-supporting members 23.

Figure 4:
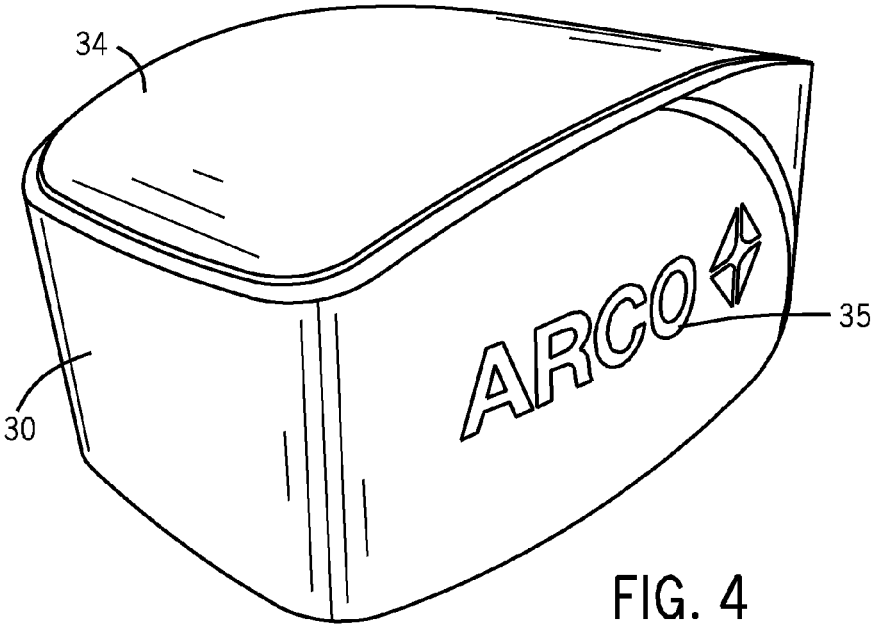
FIG. 4 is a perspective view of the outer shell of the LED-illuminated sign.
Figure 5:
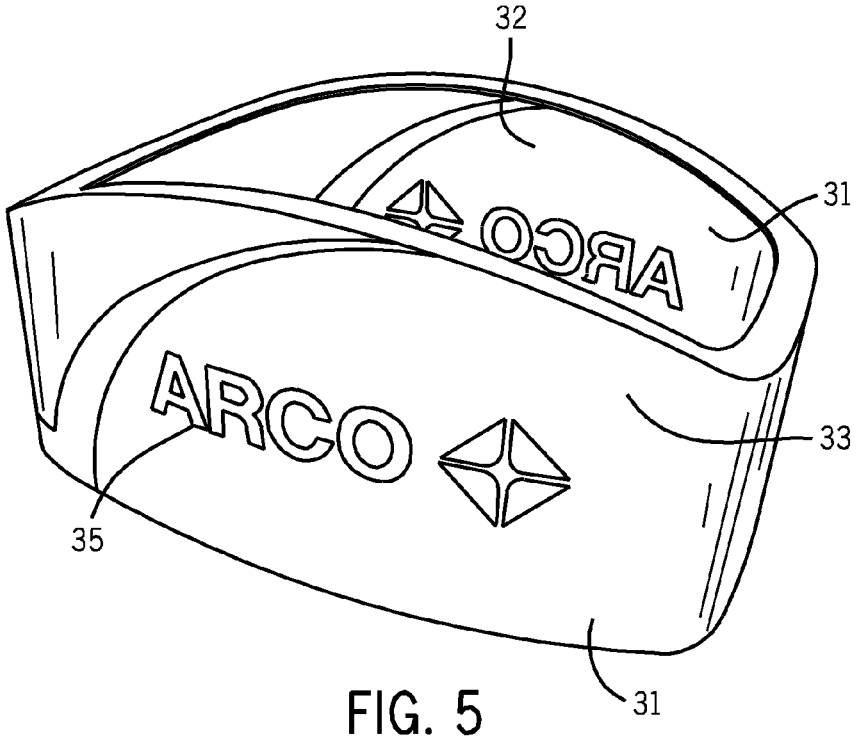
FIG. 5 is a perspective view of the outer shell as in FIG. 4, but with a topwall removed.

FIGS. 2-5 illustrate that outer shell 30 is secured to shell-supporting members 23 of frame 20 and has a pair of opposite translucent sidewalls 31 with an inner surface 32 and an outer surface 33. As seen in FIGS. 2 and 3, shell 30 and shell-supporting members 23 are configured and arranged such that each translucent sidewall 31 extends along and is spaced from outward surface 22 of a respective one of main support panels 21. Outer shell 30 further includes a topwall 34 spanning between sidewalls 31, as seen in FIG. 4.

FIG. 1 further illustrates that plurality of separate LED emitters 40 are secured on each outward surface 22 at spaced positions thereon. The spaced position the spacing 15 of each of translucent sidewalls 31 from corresponding support-panel outward surface 22 is such that translucent sidewalls 31 are illuminated substantially entirely. Each support panel 21 serves as a heat sink providing heat dissipation away from LED emitters 40.

It is best seen in FIGS. 1-3 that each support panel 21A and 21B is configured such that frame 20 defines an open region 24A and 24B, respectively, which permits some of the light from the LED emitters 40 on such support panel 21A and 21B, when reflected from inner surface 32 of the adjacent translucent sidewall 31, to pass within frame structure 20 to and through the opposite translucent sidewall 21B and 21A, respectively.

FIGS. 2 and 3 also show that LED-illuminated sign structure 10 further includes an LED driver 12 supported by frame 20 between main support panels 21.

Figure 6:
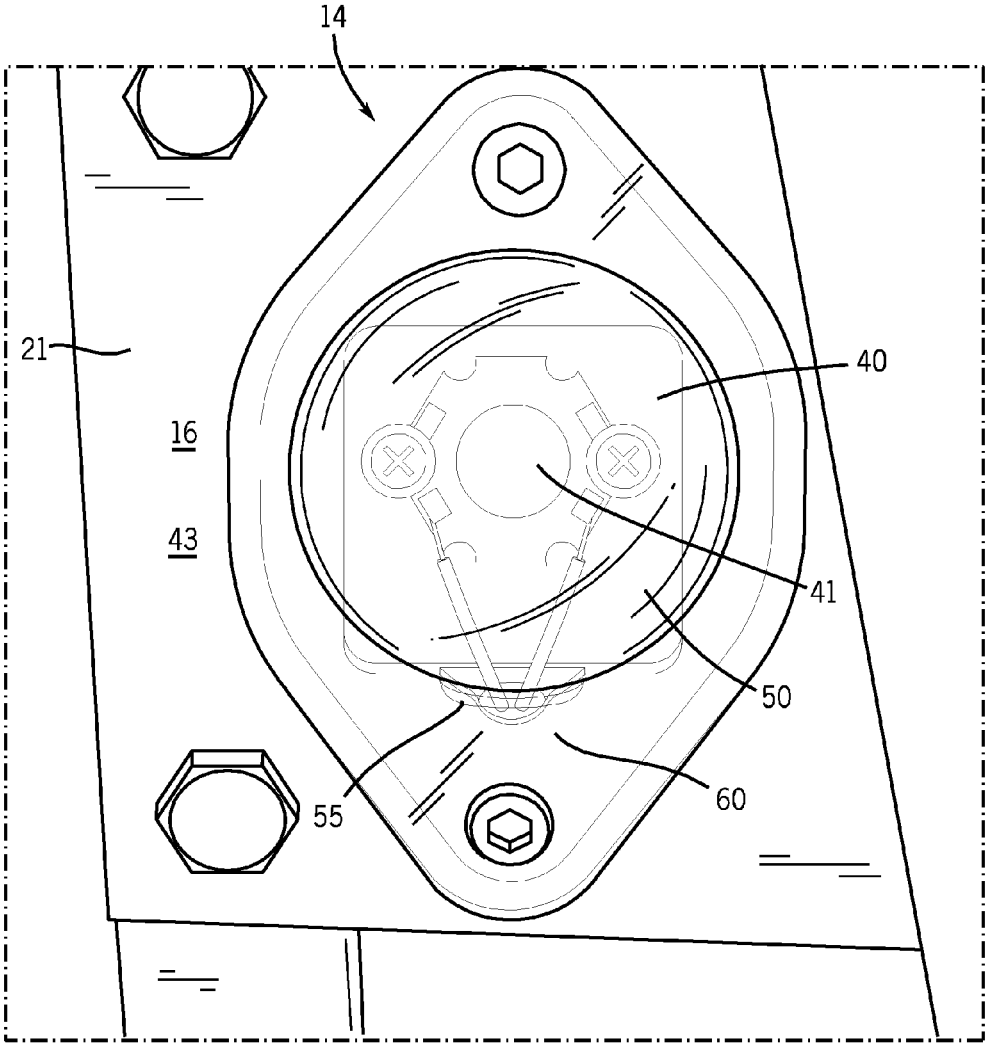
FIG. 6 is an enlarged view of an LED illuminator of this invention.

FIG. 6 shows that each LED emitter 40 includes an LED module 41 and a lens 50 thereover configured to spread the light from LED module 41, thereby to facilitate substantially uniform illumination of shell 30.

Figure 7:
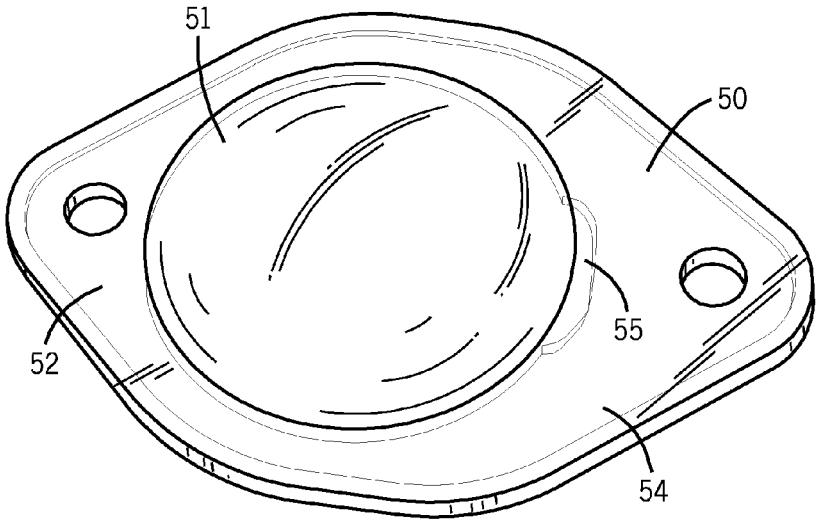
FIG. 7 is an enlarged view of a lens member of the LED illuminator of FIG. 6, showing the lens member from its free side.
Figure 8:
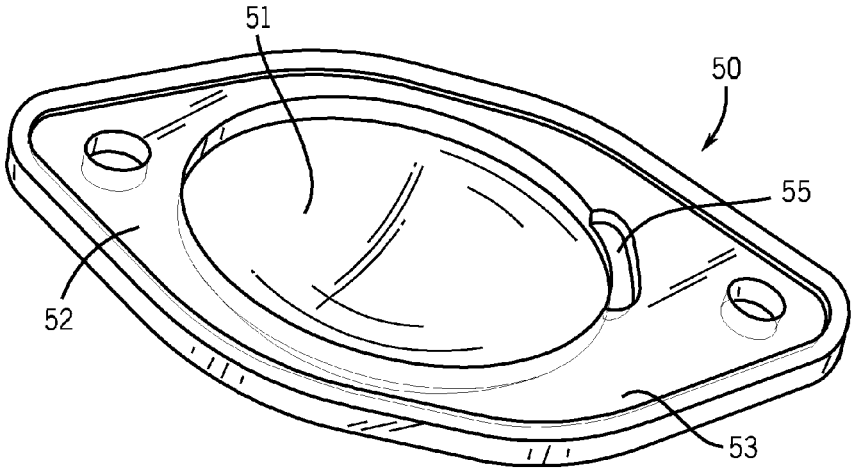
FIG. 8 is an enlarged view of a lens member of the LED illuminator of FIG. 6, showing the lens member from its mounted side.
Figure 9:
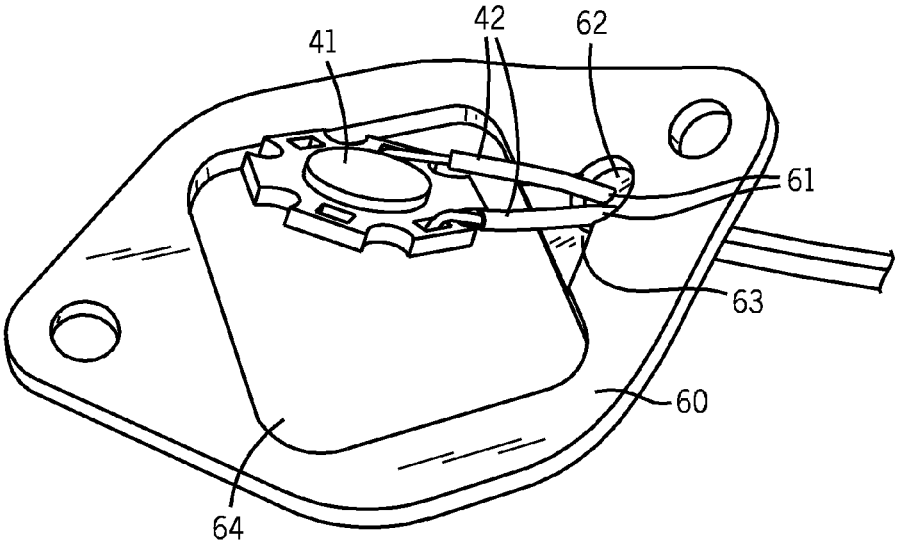
FIG. 9 is an enlarged view of a gasket and an LED emitter of the LED illuminator of FIG. 6.
Figure 10:
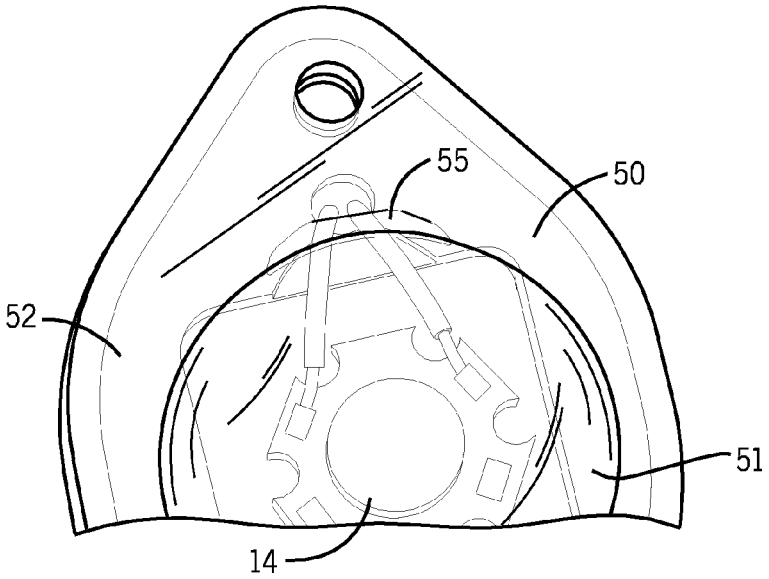
FIG. 10 is an enlarged fragmentary view of a preliminary assembly of the LED illuminator according to the present invention.

FIGS. 6-10 illustrate each LED emitter 40 as including an LED module 41 removably secured to one of the support panels 21; a one-piece lens member 50 over LED module 41, lens member 50 including a lens portion 51 and a surrounding flange portion 52 which is removably secured to such support panel 21; and a weatherproof seal 60 between flange portion 52 and support panel 21, whereby each LED emitter 40 is individually replaceable and serviceable. FIGS. 6, 9 and 10 show LED module 41 being a multi-chip module.

It is further seen in FIGS. 6, 9 and 10 that weatherproof seal 60 is a gasket configured to allow passage of wires 42 to module 41 for electrical connection. FIG. 9 best illustrates wire passage 61 in the form of wire apertures through the entire thickness of gasket 60 and surrounded by a wire recess 62 with wire guides 63 extending from recess 62 to a light opening 64 which receives LED module 41.

Frame 20 has an inward surface 25. It is seen in FIGS. 2 and 3 that LED-emitter wires 42 extend along inward surface 25. LED driver 12 is secured with respect to inward surface 25.

It is best seen in FIGS. 2-5 that outer shell 30 includes graphics 35 thereon which are illuminated by LED emitters 40.

FIGS. 1-5 further show that outer shell 30 and frame 20 are substantially rectangular. Frame 20, as shown in FIGS. 1-3, has a second pair of opposite support panels 26 each of which is connected to both of main support panels 21 and has an outward surface 27. Outer shell 30, as illustrated in FIGS. 2-5, has four translucent sidewalls 31 each of which extends along and is spaced from outward surface 22 and 27 of a respective one of support panels 21 and 26, respectively. Additional LED emitters 40 are secured on each of support panels 26 of the second pair, whereby sign structure 10 has 360° internal illumination.

FIGS. 6-10 illustrate LED illuminator 14 which includes LED emitter 40 on a mounting surface 43; one-piece lens member 50 secured to mounting surface 43 over LED emitter 40 and gasket 60 between flange portion 52 and mounting surface 43. Lens member 50 has a mounted side 53, best shown in FIG. 8, and a free side 54, shown in FIG. 7, and includes lens portion 51 and flange portion 52 outwardly extending from lens portion 51.

FIGS. 6, 9 and 10 illustrate that gasket 60 defines a wire passage 61 allowing LED-emitter wires 42 to pass therethrough for electrical connection to LED emitter 40.

FIGS. 7, 8 and 10 show that lens member 50 has a restraining ridge 55 extending from mounted side 53 thereof and positioned to press wires 42 and gasket 60 against mounting surface 43 such that wire portions 44 between ridge 55 and LED emitter 40 remain in substantially fixed position regardless of wire movement beyond restraining ridge 55.

Mounting surface 43 is a heat sink 16 for dissipating heat from LED emitter 40.

As seen in FIG. 1, LED illuminator 14 is a member of an array of LED illuminators 14 secured to mounting surface 43. Each LED illuminator 14 of the array is separately removably secured to mounting surface 43 such that each LED illuminator 14 is individually replaceable and serviceable. FIGS. 2 and 3 illustrate mounting surface 43 secured inside outer shell 30.

While the principles of the invention have been shown and described in connection with specific embodiments, it is to be understood that such embodiments are by way of example and are not limiting.

The invention claimed is:

1. An LED-illuminated sign structure comprising:

a frame including two opposite main LED-supporting panels each of which has substantially upright inward and outward surfaces;

an outer shell secured with respect to the frame and having a pair of opposite translucent sidewalls with inner and outer surfaces, the shell and the frame configured and arranged such that each translucent sidewall extends along and is spaced from the outward surface of a respective one of the main LED-supporting panels; and each main LED-supporting panel supporting a plurality of separate LED emitters on the outward surface thereof, the frame defining an open region within the shell between, through and beyond the main LED-supporting panels such that light from the LED emitters on the outward surface of each of the main LED-supporting panels, when reflected back from the inner surface of the adjacent translucent sidewall, passes through the open region, including through such main LED-supporting panel, to and through the opposite main LED-supporting panel and the respective translucent sidewall.

2. The LED-illuminated sign structure of claim 1 wherein:

the LED emitters are secured on each outward surface at spaced positions thereon such that the adjacent translucent sidewall is illuminated and that the inward surfaces are free of the light from the LED emitters on the corresponding support-panel outward surfaces; and an LED driver is supported by the frame between the main LED-supporting panels.

3. The LED-illuminated sign structure of claim 1 wherein:

the frame further comprises shell-supporting members, the outer shell being secured to the shell-supporting members; and each LED-supporting panel being a heat sink providing heat dissipation away from the LED emitters.

4. The LED-illuminated sign structure of claim 3 wherein the outer shell includes a topwall spanning between the sidewalls.

5. The LED-illuminated sign structure of claim 3 wherein each LED emitter includes:

an LED module; and a lens thereover configured to spread the light from the LED module, thereby to facilitate substantially uniform illumination of the shell.

6. The LED-illuminated sign structure of claim 5 wherein the LED module is a multi-chip module.

7. The LED-illuminated sign structure of claim 3 wherein each LED emitter includes:

an LED module removably secured to one of the support panels;

a one-piece lens member over the LED module, the lens member including a lens portion and a surrounding flange portion which is removably secured to such LED-supporting panel; and a weatherproof seal between the flange portion and the LED-supporting panel, whereby each LED emitter is individually replaceable and serviceable.

8. The LED-illuminated sign structure of claim 7 wherein the LED module is a multi-chip module.

9. The LED-illuminated sign structure of claim 7 wherein the weatherproof seal is a gasket configured to allow passage of wires to the module for electrical connection.

10. The LED-illuminated sign structure of claim 9 wherein:

the LED-emitter wires extend along the inward surface; and an LED driver is secured with respect to the inward surface.

11. The LED-illuminated sign structure of claim 3 wherein each LED emitter includes a multi-chip LED module.

12. The LED-illuminated sign structure of claim 3 wherein the outer shell includes graphics thereon which are illuminated by the LED emitters.

13. The LED-illuminated sign structure of claim 3 wherein:

the outer shell and the frame are substantially rectangular, the frame having a second pair of opposite LED-supporting panels each of which is connected to both of the main LED-supporting panels and has an outward surface;

the outer shell has four translucent sidewalls each of which extends along and is spaced from the outward surface of a respective one of the LED-supporting panels; and additional LED emitters are secured on each of the LED-supporting panels of the second pair, whereby the sign structure has 360° internal illumination.

14. An LED illuminator comprising:

an LED emitter on a substantially planar mounting surface;

a one-piece lens member secured to the mounting surface and having an inner face facing the LED emitter and the mounting surface, the lens member including (a) a lens portion and (b) a flange portion extending outwardly from the lens portion; and a gasket between the mounting surface and the inner face of the lens member at the flange portion, the gasket defining a wire passage for wires passing therethrough for electrical connection to the LED emitter, the lens member having a restraining ridge extending from the inner face thereof and pressing the wires and the gasket against the mounting surface such that the wire portions between the ridge and the LED emitter remain in substantially fixed position regardless of wire movement beyond the restraining ridge.

15. The LED illuminator of claim 14 wherein the mounting surface is a heat sink for dissipating heat from the LED emitter.

16. The LED illuminator of claim 14 being a member of an array of LED illuminators secured to the mounting surface, each LED illuminator of the array being separately removably secured to the mounting surface such that each LED illuminator is individually replaceable and serviceable.

17. The LED illuminator of claim 14 wherein the mounting surface is secured inside an outer shell, the shell including a translucent wall which has inner and outer surfaces, the inner surface of the translucent wall being spaced from the mounting surface such that the translucent wall is illuminated substantially entirely.

18. The LED illuminator of claim 16 further including an LED driver supported inside an outer shell.

* * * * *

UNITED STATES PATENT AND TRADEMARK OFFICE

CERTIFICATE OF CORRECTION

PATENT NO. : 9,105,206 B2
APPLICATION NO. : 12/977282
DATED : August 11, 2015
INVENTOR(S) : Miletich et al.

It is certified that error appears in the above-identified patent and that said Letters Patent is hereby corrected as shown below:

At column 4, line 5, after the word "position" insert --and--.

Signed and Sealed this
Twenty-third Day of August, 2016

Michelle K. Lee

Michelle K. Lee
*Director of the United States Patent and Trademark Office*